US011384758B2

(12) United States Patent
Fabry

(10) Patent No.: US 11,384,758 B2
(45) Date of Patent: Jul. 12, 2022

(54) CYLINDRICAL SYMMETRIC VOLUMETRIC MACHINE WITH AN INLET VENTILATOR

(71) Applicant: ATLAS COPCO AIRPOWER, NAAMLOZE VENNOOTSCHAP, Wilrijk (BE)

(72) Inventor: Erik Paul Fabry, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 173 days.

(21) Appl. No.: 16/635,810

(22) PCT Filed: Sep. 11, 2018

(86) PCT No.: PCT/IB2018/056923
§ 371 (c)(1),
(2) Date: Jan. 31, 2020

(87) PCT Pub. No.: WO2019/058212
PCT Pub. Date: Mar. 28, 2019

(65) Prior Publication Data

US 2021/0033090 A1 Feb. 4, 2021

(30) Foreign Application Priority Data

Sep. 21, 2017 (BE) ..... 2017/5673

(51) Int. Cl.
*F04C 2/107* (2006.01)

(52) U.S. Cl.
CPC ..... *F04C 2/1076* (2013.01); *F04C 2/107* (2013.01)

(58) Field of Classification Search
CPC ..... F04C 2/107; F04C 2/1076
See application file for complete search history.

(56) References Cited

U.S. PATENT DOCUMENTS 1,892,217 A 12/1932 Moineau
4,482,305 A * 11/1984 Natkai ..... F01C 1/107 418/150

(Continued)

FOREIGN PATENT DOCUMENTS

JP 60147797 U * 10/1985
TW 477859 B 3/2002

(Continued)

OTHER PUBLICATIONS

International Search Report for PCT/IB2018/056923 dated Dec. 21, 2018 (PCT/ISA/210).

(Continued)

*Primary Examiner* — Mary Davis
(74) *Attorney, Agent, or Firm* — Sughrue Mion, PLLC

(57) ABSTRACT

A cylindrical symmetric volumetric machine, includes a housing (2) with two co-operating rotors (6*a*, 6*b*) therein, namely an outer rotor (6*a*) mounted rotatably in the housing (2) and an inner rotor (6*b*) mounted rotatably in the outer rotor (6*a*), whereby a compression chamber (8) is located between the rotors (6*a*, 6*b*), which will move by rotation of the rotors (6*a*, 6*b*) from the inlet side (9*a*) of the rotors (6*a*, 6*b*) to the outlet side (9*b*) of the rotors (6*a*, 6*b*), wherein the inlet side (9*a*) of the outer rotor (6*a*) is provided with a ventilator (12), to supply air to the compression chamber (8).

11 Claims, 3 Drawing Sheets

(56) References Cited

U.S. PATENT DOCUMENTS

Figure 1:
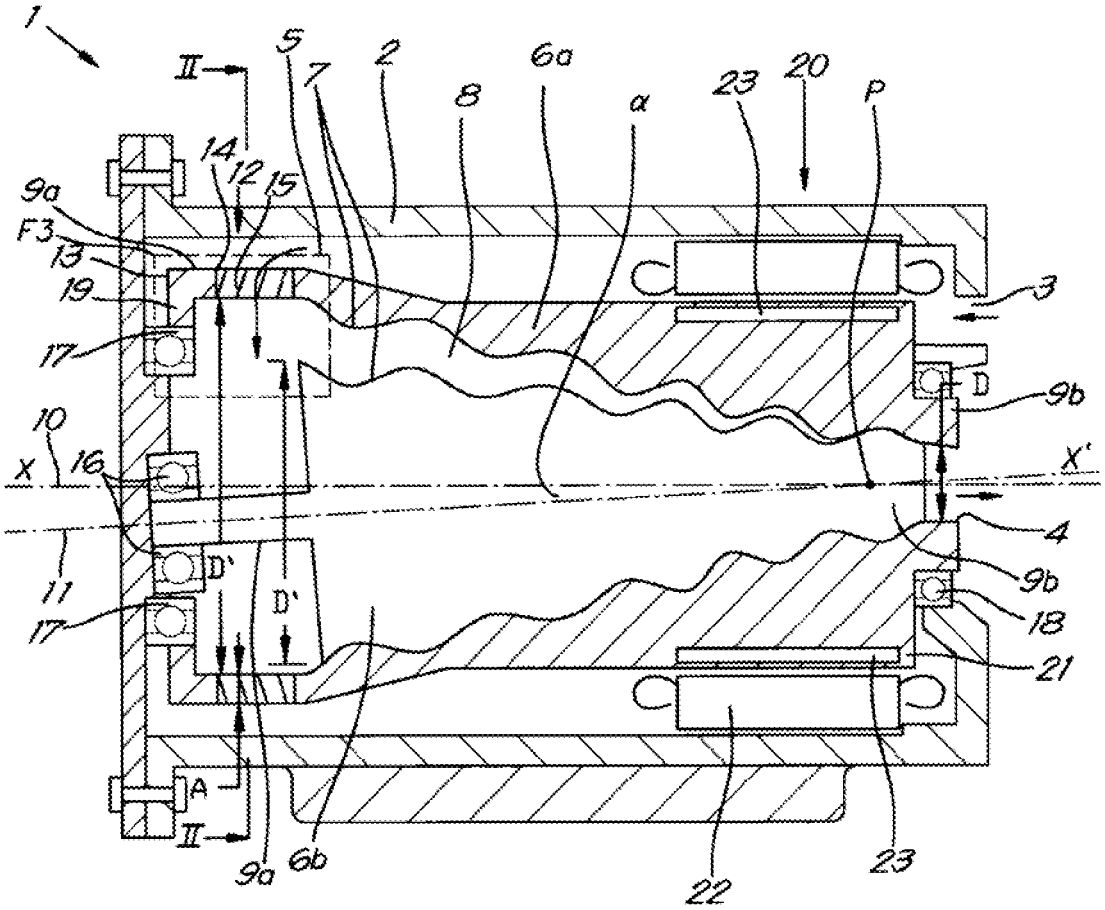

| | | | | |
|---|---|---|---|---|
| 4,863,357 | A * | 9/1989 | Olofsson | F01C 1/107 417/356 |
| 2010/0092317 | A1* | 4/2010 | Suhara | F04C 15/008 417/410.4 |
| 2017/0074264 | A1* | 3/2017 | Horimatsu | F04C 15/008 |
| 2017/0227008 | A1* | 8/2017 | Dmitriev | F04C 2/107 |
| 2020/0217320 | A1* | 7/2020 | Fabry | F04C 2/102 |

FOREIGN PATENT DOCUMENTS

| | | | |
|---|---|---|---|
| WO | 2008/000505 | A1 | 1/2008 |
| WO | 2015/124918 | A1 | 8/2015 |

OTHER PUBLICATIONS

Written Opinion of the International Searching Authority for PCT/IB2018/056923 dated Dec. 21, 2018 (PCT/ISA/237).

* cited by examiner

CYLINDRICAL SYMMETRIC VOLUMETRIC MACHINE WITH AN INLET VENTILATOR

CROSS REFERENCE TO RELATED APPLICATIONS

This application is a National Stage of International Application No. PCT/IB2018/056923 filed Sep. 11, 2018, claiming priority based on Belgium Patent Application No. 2017/5673, filed Sep. 21, 2017.

BACKGROUND OF THE INVENTION

Field of the Invention

The present invention relates to a cylindrical symmetric volumetric machine.

Background

A volumetric machine is also known under the name "positive displacement machine".

In particular, the invention is intended for machines such as expanders, compressors and pumps with a cylindrical symmetry with two rotors, namely an inner rotor mounted rotatably in an outer rotor.

Such machines are already known and are described in U.S. Pat. No. 1,892,217 among others. It is also known that the rotors can have a cylindrical or conical shape.

It is known that such machines can be driven with an electric motor.

From Belgian patent application no. BE 2017/5459 it is already known that the electric motor can be mounted around the outer rotor, whereby the motor stator directly drives the outer rotor.

Such machine has many advantages in relation to the known machines whereby the motor shaft is connected by means of a transmission with the rotor shaft of the outer or inner rotor.

Thus, the machine will not only be a lot more compact, such that the footprint is smaller, it also means less shaft seals and bearings are required.

The efficiency of the machine is largely determined by the fill ratio of the so-called compression chamber, this is a space between the lobes of the rotors which will move by rotation of the rotors from the inlet side to the outlet side and thereby decreases in volume such that the gas enclosed in the space will be compressed.

The purpose of the present invention is to improve the fill ratio of such machine.

SUMMARY OF THE INVENTION

To this end, the invention relates to a cylindrical symmetric volumetric machine, whereby the machine comprises a housing with two co-operating rotors therein, namely an outer rotor mounted rotatably in the housing and an inner rotor mounted rotatably in the outer rotor, whereby a compression chamber is located between the rotors, which moves by rotation of the rotors from the inlet side to the outlet side, characterised in that the inlet side of the outer rotor is provided with a ventilator, to supply air to the compression chamber.

This provides the advantage that the ventilator will ensure a centripetal flow of air at the inlet, such that a better filling of the compression chamber is obtained.

Therefore, the performance of the machine will increase.

This will also offset any premature compression chamber volume reduction occurring before it closes.

Another advantage is that the actively sucked in air is also suitable to cool, for example, a motor which drives the machine, the outlet or the oil that is used for the lubrication and/or cooling of components of the machine.

That can be realised by sending the sucked in air along or via said components before it ends up in the compression chamber.

In a practical embodiment the outer rotor is provided with an attachment on its inlet side wherein the ventilator is built in, which is attached to the outer rotor.

This attachment can consist of a hollow cylindrical element, which is placed with its axis in the extension of the axis of the outer rotor.

According to a preferred characteristic of the invention the outer rotor is mounted rotatably in the housing by means of a bearing on or to said attachment.

The advantage is that a smaller bearing can be used. Indeed, the attachment can itself be provided with a radially inward oriented collar, for example, such that the bearing can be attached to or on this collar.

BRIEF DESCRIPTION OF THE INVENTION

Figure 2:
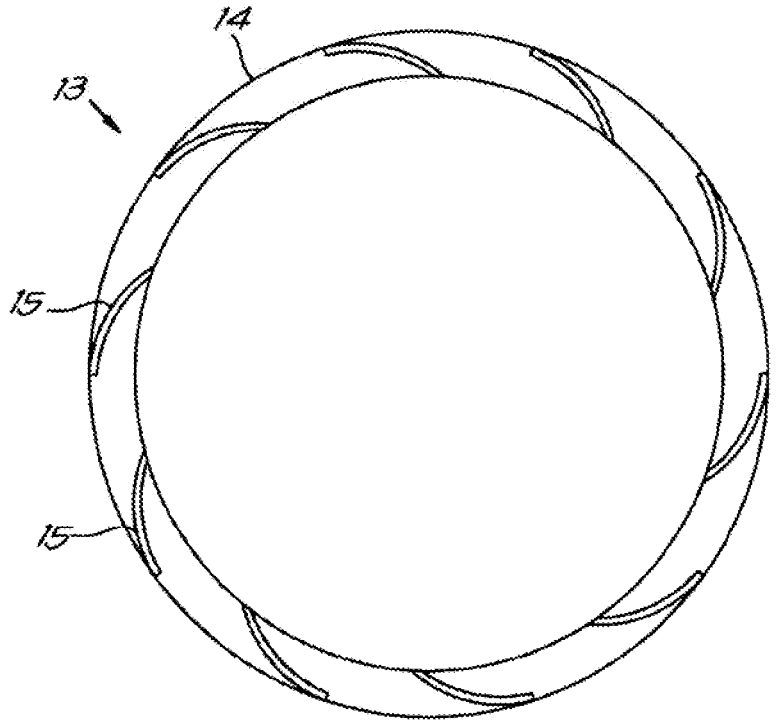
Figure 3:
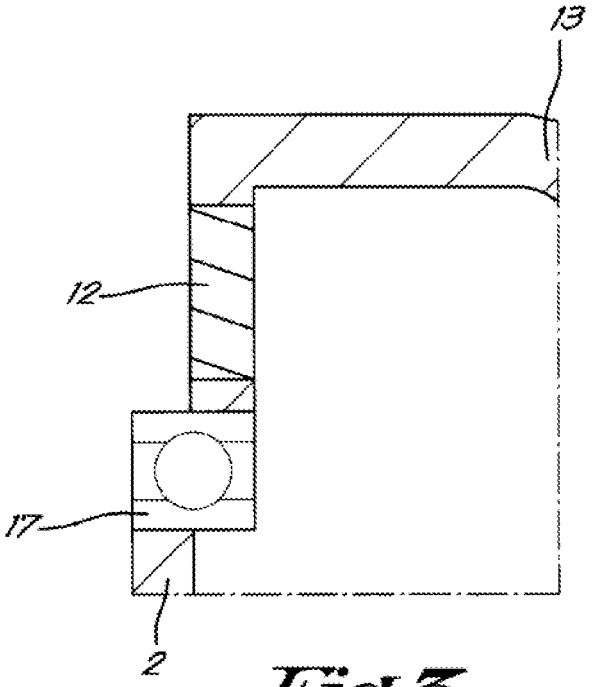
Figure 4:
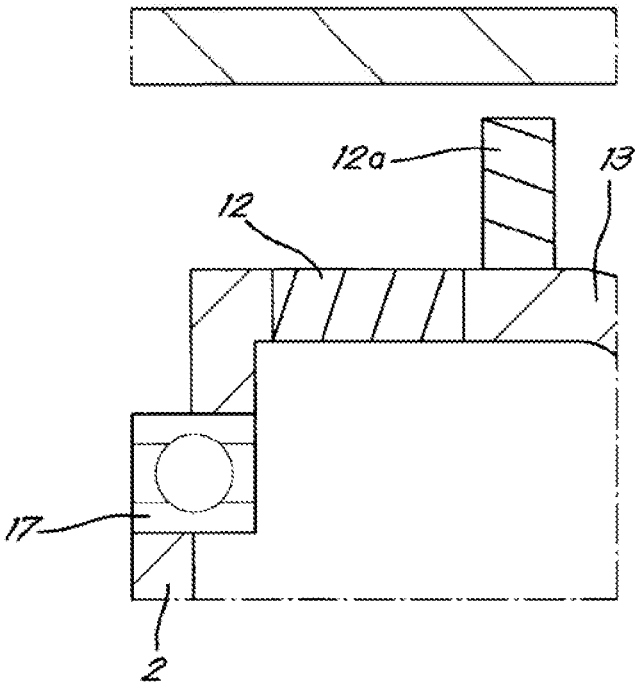
Figure 5:
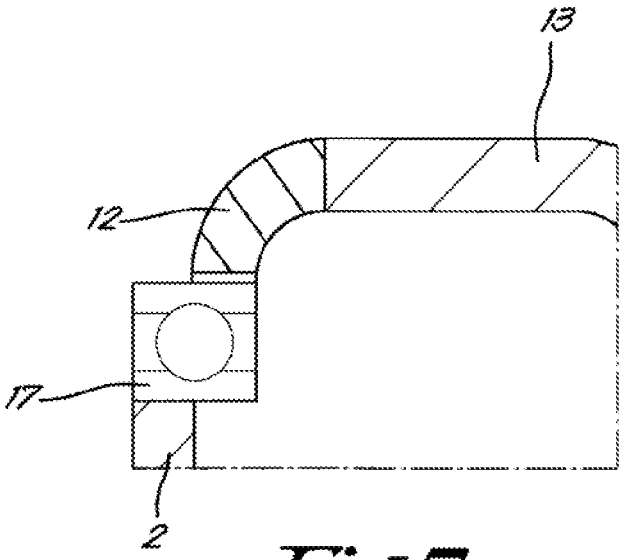

With the intention of better showing the characteristics of the invention, a few preferred embodiments of a cylindrical symmetric volumetric machine according to the invention are described hereinafter by way of an example, without any limiting nature, with reference to the accompanying drawings, wherein:

FIG. 1 schematically shows a cylindrical symmetric volumetric machine according to the invention;

FIG. 2 shows a cross-section according to line II-II of FIG. 1;

FIG. 3 schematically shows an alternative embodiment of the section indicated in FIG. 1 with F3;

FIG. 4 schematically shows a variant of FIG. 3;

FIG. 5 schematically shows another variant of FIG. 3.

DETAILED DESCRIPTION OF THE INVENTION

The machine 1 schematically shown in FIG. 1 is a compressor device in this case.

According to the invention it is also possible that the machine 1 relates to an expander device. The invention can also relate to a pump device.

The machine 1 is a cylindrical symmetric volumetric machine 1. This means that the machine 1 has a cylindrical symmetry, i.e. the same symmetrical properties as a cone.

The machine 1 comprises a housing 2 that is provided with an inlet opening 3 to suck in gas to be compressed and with an outlet opening 4 for compressed gas. The housing defines a chamber 5.

Two co-operating rotors 6*a*, 6*b*, namely an outer rotor 6*a* mounted rotatably in the housing 2 and an inner rotor 6*b* mounted rotatably in the outer rotor 6*a* are located in the chamber 5 in the housing 2 of the machine 1.

Both rotors 6*a*, 6*b* are provided with lobes 7 and can turn into each other co-operatively, whereby between the lobes 7 a compression chamber 8 is created, the volume of which can be reduced by the rotation of the rotors 6*a*, 6*b*, such that the gas that is caught in this compression chamber 8 is compressed. The principle is very similar to the known adjacent co-operating screw rotors.

During the rotation of the rotors 6*a*, 6*b*, said compression chamber 8 moves from one end 9*a* of the rotors 6*a*, 6*b* to the other end 9*b* of the rotors 6*a*, 6*b*.

The end 9*a* will also be referred to as the inlet side 9*a* of the inner and outer rotor 6*a*, 6*b* and the end 9*b* of the inner and outer rotor 6*a*, 6*b* will be referred to as the outlet side 9*b* in what follows.

In the example shown, the rotors 6*a*, 6*b* have a conical shape, whereby the diameter D, D' of the rotors 6*a*, 6*b* decreases in the axial direction X-X'. However, this is not necessary for the invention; the diameter D, D' of the rotors 6*a*, 6*b* can also be constant or vary in another way in the axial direction X-X'.

Such design of rotors 6*a*, 6*b* is suitable both for a compressor and expander device. Alternatively, the rotors 6*a*, 6*b* can also have a cylindrical form with a constant diameter D, D'. They can then either have a variable pitch, such that there is a built-in volume ratio, in the case of a compressor or expander device, or a constant pitch, in the case the machine 1 relates to a pump device.

The axis 10 of the outer rotor 6*a* and the axis 11 of the inner rotor 6*b* are fixed axes 10, 11, this means that the axes 10, 11 will not move in relation to the housing 2 of the machine 1, however they do not run parallel, but are located at an angle $\alpha$ in relation to each other, whereby the axes intersect in point P.

However, this is not necessary for the invention. For example, if the rotors 6*a*, 6*b* have a constant diameter D, D', the axes 10, 11 can nevertheless run parallel.

According to the invention the inlet side 9*a* of the outer rotor 6*a* is provided with a ventilator 12, to supply air to the compression chamber 8.

This means that the ventilator 12 will turn with the outer rotor 6*a*, such that when the rotors 6*a*, 6*b* turn, the ventilator 12 will also start running.

In this case the ventilator 12 is a radial ventilator 12.

In the example shown in FIGS. 1 and 2, the outer rotor 6*a* is provided with an attachment 13 on the inlet side 9*a* in which the ventilator 12 is built in, which is attached to the outer rotor 6*a*.

In this case, the attachment 13 comprises a hollow cylindrical form, which is placed with its axis in the extension of the axis 10 of the outer rotor 6*a*.

The attachment 13 has a wall 14 with a certain thickness A, whereby ventilator blades 15 have been mounted in this wall 14.

It is not excluded that the height of one or more of the blades 15 decreases axially from the inside to the outside in the radial direction.

In this way the reduced contour can be accommodated.

The rotors 6*a*, 6*b* are mounted on bearings in the machine 1, whereby the inner rotor 6*b* on one end 9*a* is mounted in the machine 1 on a bearing 16 and the other end 9*b* of the inner rotor 6*b* is supported or borne by the outer rotor 6*a* as it were.

In the example shown, the outer rotor 6*a* is mounted at both ends 9*a*, 9*b* in the machine 1 with bearings 17, 18.

As shown in FIG. 1, the outer rotor at the inlet side 9*a* is mounted rotatably in the housing 2 by means of a bearing 17 on or to said attachment 13.

The attachment 13 is provided with a radially inward oriented collar 19, on which said bearing 17 is mounted.

Consequently this bearing 17 can be made much smaller, i.e. with a smaller diameter, compared to the case whereby the bearing 17 is mounted directly on the outer rotor 6*a* itself.

Further, the machine 1 is also provided with an electric motor 20 which will drive the rotors 6*a*, 6*b*. This motor 20 is provided with a motor rotor 21 and a motor stator 22.

In this case, but not necessarily, the electric motor 20 is mounted around the outer rotor 6*a* whereby the motor stator 22 directly drives the outer rotor 6*a*.

In the example shown, this is realised because the outer rotor 6*a* also serves as motor rotor 21.

The electric motor 20 is provided with permanent magnets 23 which are embedded in the outer rotor 6*a*.

It is also possible of course that these magnets 23 are not embedded in the outer rotor 6*a*, but are mounted on the outside thereof for example.

Instead of an electric motor 20 with permanent magnets 23 (i.e. a synchronous permanent magnet motor), an asynchronous induction motor can also be applied, whereby the magnets are replaced with a squirrel-cage rotor.

Induction from the motor stator generates a current in the squirrel-cage rotor.

On the other hand, the motor 20 can also be a reluctance type or induction type or a combination of types.

The motor stator 22 is mounted around the outer rotor 6*a* in a covering way, whereby in this case it is located in the housing 2 of the machine 1.

In this way the lubrication of the motor 20 and the rotors 6*a*, 6*b* can be controlled together, as they are located in the same housing 2 and consequently are not closed off from each other.

The operation of the device 1 is very simple and as follows.

During the operation of the machine 1, the motor stator 22 will drive the motor rotor 21 and therefore drive the outer rotor 6*a* in the known way.

The outer rotor 6*a* will help drive the inner rotor 6*b*, and by the rotation of the outer rotor 6*a*, the ventilator 12 will also turn.

Due to the operation of the ventilator 12 gas will be sucked in via the inlet opening 3. This gas will end up in the compression chamber 8 between the rotors 6*a*, 6*b*.

Because the ventilator 12 will ensure an active supply or flow of gas, the fill ratio of the compression chamber 8 will be increased.

Furthermore, the gas, when the gas is sucked in via the inlet opening 3, will flow past the motor rotor 21 and the motor stator 22. In this way the gas will be able to ensure an active cooling of the motor 20.

Due to the rotation this compression chamber 8 moves to the outlet 4 and at the same time will reduce in terms of volume to thus realise a compression of the gas.

The compressed gas can then exit the machine 1 via the outlet opening 4.

It is not excluded that during the compression, liquid is injected in the machine 1.

Said liquid can both be water and a synthetic or non-synthetic oil.

FIG. 3 shows an alternative embodiment of the ventilator 12, whereby it is now an axial ventilator 12.

In this case the attachment 13 is not cylindrical, but more conical. This, however, is not necessary. The axial ventilator 12 is built into the radially inward oriented collar 19.

In FIG. 4 the radial ventilator 12 of FIG. 1 is shown in combination with an additional axial ventilator 12*a* which are placed in series with each other.

In this case the additional axial ventilator 12*a* is placed in front of the radial ventilator 12, seen in the flow direction of the sucked in air. It is also possible of course that the radial ventilator 12 is placed in front of the additional axial ventilator 12*a*.

The additional axial ventilator 12*a* is mounted around the attachment 13.

FIG. 5 shows an additional variant whereby in this case the ventilator 12 is a mixed axial-radial ventilator 12, whereby the blades 15 have both an axial and a radial section.

The operation of the ventilator 12 in the embodiments of FIGS. 3 to 5 is analogue to the operation of the embodiment in FIGS. 1 and 2.

The present invention is by no means limited to the embodiments described as an example and shown in the drawings, but a cylindrical symmetric volumetric machine according to the invention can be realised in all kinds of forms and dimensions, without departing from the scope of the invention.

The invention claimed is:

1. A cylindrical symmetric volumetric machine comprising:

a housing (2) with two co-operating rotors (6*a*, 6*b*) therein, including an outer rotor (6*a*) mounted rotatably in the housing (2) and an inner rotor (6*b*) mounted rotatably in the outer rotor (6*a*);

a compression chamber (8) located between the inner rotor and the outer rotor, which will move by rotation of the inner rotor and the outer rotor from the inlet side (9*a*) of the inner rotor and the outer rotor to the outlet side (9*b*) of the inner rotor and the outer rotor; and a ventilator (12) attached to the outer rotor (6*a*) at the inlet side thereof such that the blades rotate upon rotation of the outer rotor to supply air to the compression chamber (8).

2. The cylindrical symmetric volumetric machine according to claim 1, wherein the outer rotor (6*a*) is provided with an attachment (13) on its inlet side (9*a*) in which the ventilator (12) is built in, and which is attached to the outer rotor (6*a*).

3. The cylindrical symmetric volumetric machine according to claim 2, wherein the outer rotor (6*a*) is mounted rotatably in the housing (2) by means of a bearing (17) connected to said attachment (13).

4. The cylindrical symmetric volumetric machine according to claim 1, wherein the ventilator (12) is a radial ventilator (12).

5. The cylindrical symmetric volumetric machine according to claim 4, wherein an additional axial ventilator (12*a*) is provided in series with said radial ventilator (12).

6. The cylindrical symmetric volumetric machine according to claim 1, wherein the ventilator (12) is an axial ventilator (12).

7. The cylindrical symmetric volumetric machine according to claim 1, wherein the ventilator (12) is a mixed axial-radial ventilator (12), whereby the blades (15) have both an axial and radial section.

8. The cylindrical symmetric volumetric machine according to claim 1, wherein the inner rotor (6*b*) and the outer rotor (6*a*) have a conical shape.

9. The cylindrical symmetric volumetric machine according to claim 1, wherein the machine (1) is provided with an electric motor (20) with a motor rotor (21) and motor stator (22) to drive the inner and outer rotor (6*a*, 6*b*), whereby the electric motor (20) is mounted around the outer rotor (6*a*), whereby the motor stator (22) directly drives the outer rotor (6*a*).

10. The cylindrical symmetric volumetric machine according to claim 9, wherein the outer rotor (6*a*) serves as the motor rotor (21).

11. The cylindrical symmetric volumetric machine according to claim 10, wherein the electric motor (20) is provided with permanent magnets (23) embedded in the outer rotor (6*a*).

* * * * *